US012269566B2

(12) United States Patent
Smith et al.

(10) Patent No.: US 12,269,566 B2
(45) Date of Patent: Apr. 8, 2025

(54) BOAT STAND WITH STACKABLE BOAT STAND BASE

(71) Applicant: Grady F. Smith & Co., Inc., Greenville, NC (US)

(72) Inventors: Grady F. Smith, Greenville, NC (US); James Alan Gell, Bethel, NC (US)

(73) Assignee: GRADY F. SMITH & CO., INC., Greenville, NC (US)

( * ) Notice: Subject to any disclaimer, the term of this patent is extended or adjusted under 35 U.S.C. 154(b) by 40 days.

(21) Appl. No.: 18/199,561

(22) Filed: May 19, 2023

(65) Prior Publication Data

US 2024/0383588 A1 Nov. 21, 2024

(51) Int. Cl.
*B63C 5/02* (2006.01)

(52) U.S. Cl.
CPC ..... *B63C 5/02* (2013.01); *B63C 2005/022* (2013.01)

(58) Field of Classification Search
CPC ..... B63C 5/02; B63C 2005/022; B66F 3/08; A47C 3/04; A47B 9/02; F16M 11/28; F16M 2200/08
USPC ..... 248/405, 354.1, 354.3, 352, 440, 188.91
See application file for complete search history.

(56) References Cited

U.S. PATENT DOCUMENTS 471,184 A * 3/1892 Milner ..... A47C 3/24 248/188.91
2,005,003 A * 6/1935 Patton ..... B60C 25/02 157/16
2,487,827 A * 11/1949 Persson ..... F16M 11/10 248/354.3
3,642,243 A * 2/1972 Smith ..... F16M 11/046 248/354.3
3,920,212 A * 11/1975 Westwood ..... B66F 13/00 248/352
4,756,642 A * 7/1988 Quinn ..... B63C 5/02 248/354.1
6,030,037 A * 2/2000 Ritch ..... A47C 7/004 297/331
8,926,217 B1 * 1/2015 Smith ..... B63C 3/12 248/176.1
2006/0071139 A1 * 4/2006 Lemirande ..... B66F 13/00 248/352
2015/0076876 A1 * 3/2015 Hasegawa ..... A47C 3/20 248/188.7
2016/0273701 A1 * 9/2016 Heyring ..... F16M 11/22
2017/0065074 A1 * 3/2017 Ilse ..... A47C 7/002
2021/0245850 A1 * 8/2021 Smith ..... B63C 5/02

* cited by examiner

*Primary Examiner* — Christopher Garft
(74) *Attorney, Agent, or Firm* — COATS & BENNETT, PLLC

(57) ABSTRACT

A boat stand includes a base that stacks compactly when not in use. The base comprises a vertical support column, a first pair of support legs extending from the support column in a first direction relative to a transverse plane of the boat stand, and a second pair of support legs extending from the support column in a second direction relative to the transverse plane. The first pair of support legs connect to the support column at a first distance from a top end of the support column. The second pair of support legs connect to the support column at a second distance from the top end of the support column greater than the first distance so as to enable compact stacking of two or more boat stands.

14 Claims, 10 Drawing Sheets

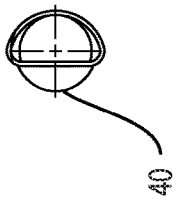
FIG. 7B
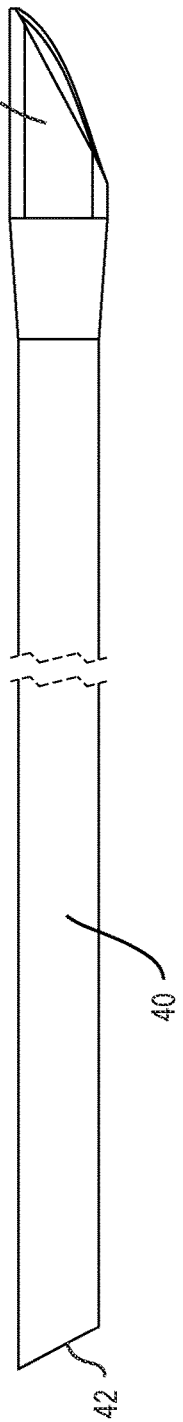
FIG. 7A
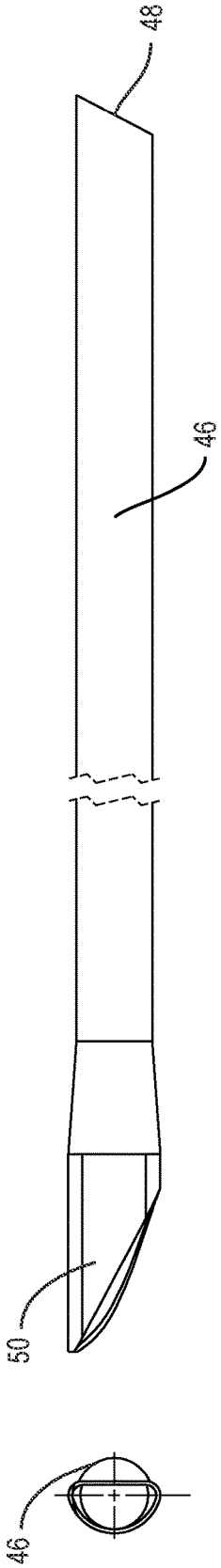
FIG. 7D
FIG. 7C
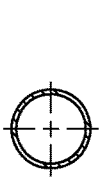
FIG. 8B
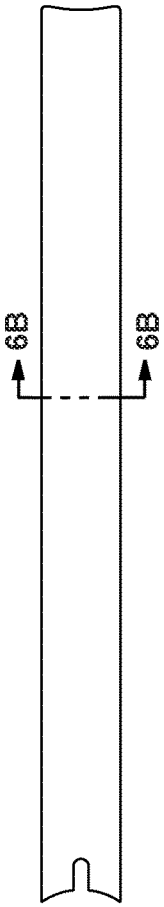
FIG. 8A

BOAT STAND WITH STACKABLE BOAT STAND BASE

TECHNICAL FIELD

The present disclosure relates generally boat stands for supporting boats during dry storage or repair and, more specifically, to stackable bases for boat stands.

BACKGROUND

Boat stands are used to support boats during dry storage or repair. A typical boat stand comprises a vertical column supported by three to four legs and containing a threaded shaft with a pad on top. The threaded shaft is used to adjust the height of the pad. In use, multiple boat stands typically support the port and starboard sides of the hull while the keel rests on keel blocks. When not in use, it is desirable to stack portions of the boat stands, such as the boat stand base having the vertical column and the three to four legs, to minimize the space required to store the boat stands.

SUMMARY

The present disclosure relates generally to a boat stand base that stacks compactly with similar boat stand base(s) when not in use. Potential sources of interference that prevent the compact stacking of the boat stand bases are reduced or eliminated to enable more compact stacking. These sources of interference include interference between the legs of the boat stand bases, interference between the legs and the support columns of the boat stand bases, and interference between the legs and the base members of the boat stand bases.

One aspect of the disclosure comprises a boat stand for supporting a boat on dry land. The boat stand comprises a base, a screw jack, and a pad assembly. The base comprises a vertical support column, a first pair of support legs extending from the support column in a first direction (e.g., angularly forward) relative to a transverse plane of the boat stand base, and a second pair of support legs extending from the support column in a second direction (e.g., angularly rearward) relative to the transverse plane. The first pair of support legs connect to the support column at a first distance from a top end of the support column. The second pair of support legs connect to the support column at a second distance from the top end of the support column greater than the first distance so as to enable compact stacking of two or more boat stand bases. The screw jack fits into the upper end of the support column. The pad assembly attaches to an upper end of the screw jack.

Another aspect of the disclosure comprises a base for a boat stand base that stacks compactly with other boat stand base(s) when not in use. The base comprises a vertical support column, a first pair of support legs extending from the support column in a first direction (e.g., angularly forward) relative to a transverse plane of the boat stand base, and a second pair of support legs extending from the support column in a second direction (e.g., angularly rearward) relative to the transverse plane. The first pair of support legs connect to the support column at a first distance from a top end of the support column. The second pair of support legs connect to the support column at a second distance from the top end of the support column greater than the first distance so as to enable compact stacking of two or more boat stand bases.

BRIEF DESCRIPTION OF THE DRAWINGS

FIGS. 7A and 7B are side and end views respectively of a support leg on a first side of the base.

FIGS. 7C and 7D are side and end views respectively of a support leg on a second side of the base.

FIGS. 8A and 8B are top and end views respectively of an optional brace for a base.

DETAILED DESCRIPTION

Figure 1:
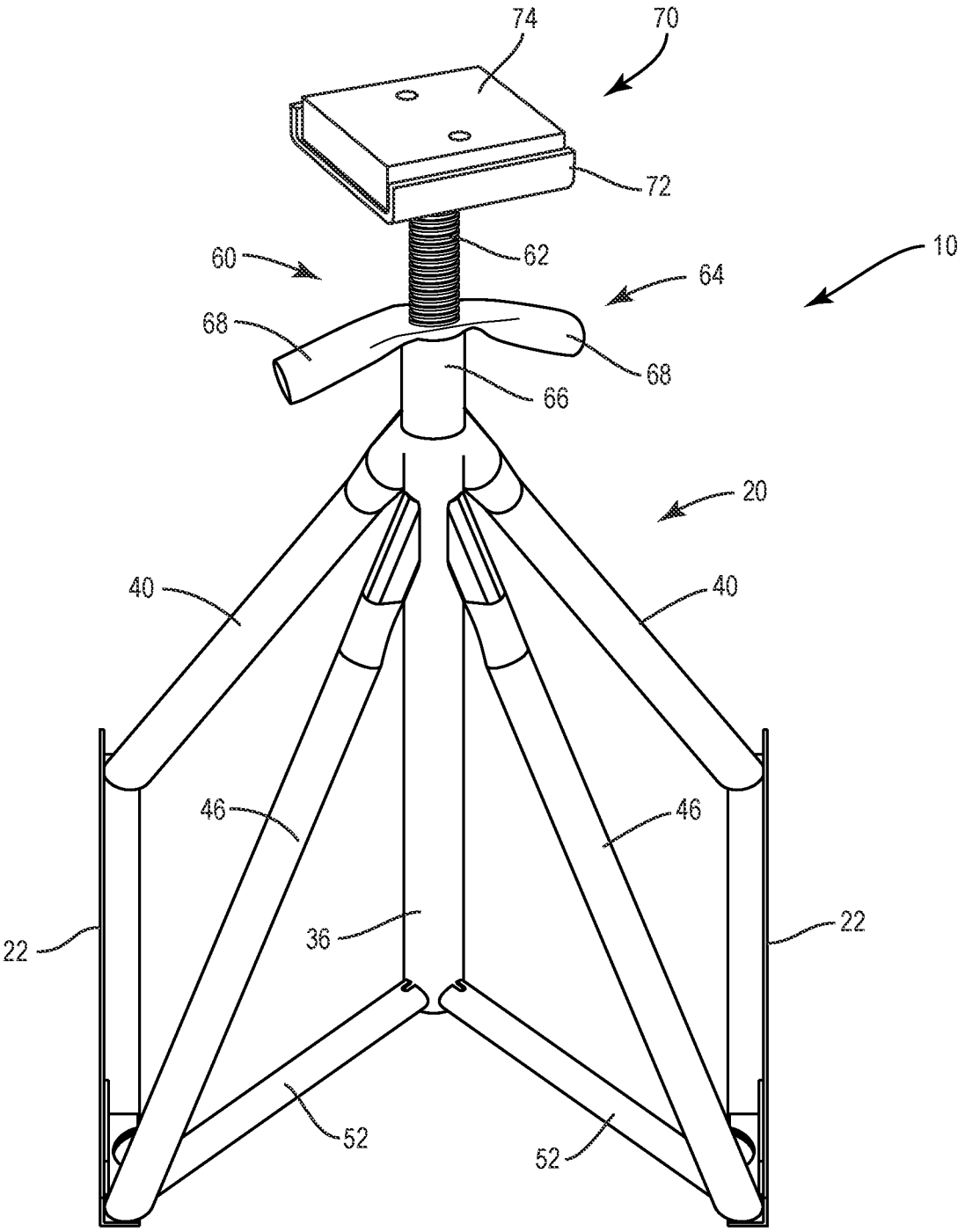
FIG. 1 is a perspective view of the boat stand.
Figure 2:
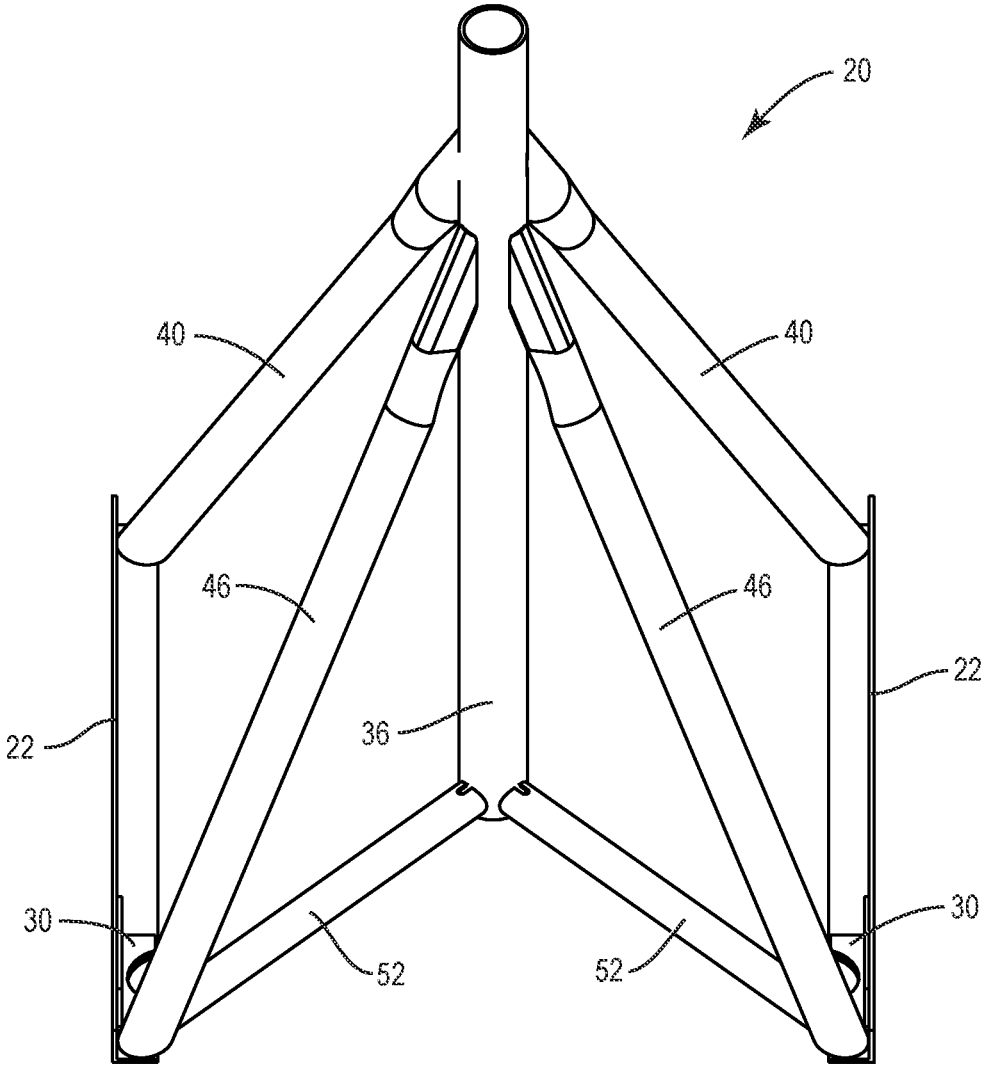
FIG. 2 is a perspective view of a base for a boat stand.
Figure 3:
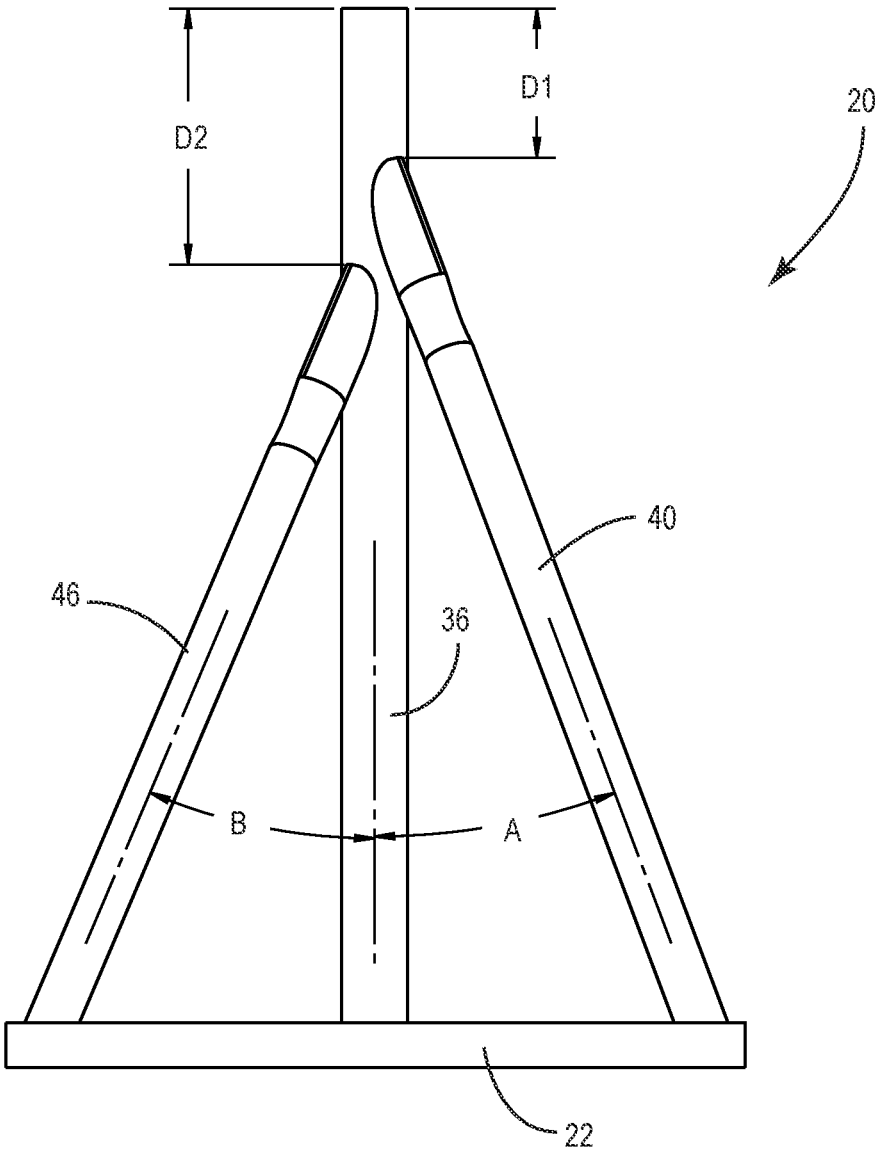
FIG. 3 is a side view of the base.

Referring now to the drawings, FIGS. 1-3 illustrate one exemplary embodiment of a stackable boat stand 10. The boat stand 10 generally comprises a base 20, a screw jack 60 extending upward from the base 20, and a pad assembly 70 attached to a top end of the screw jack 60. The base 20 of the boat stand 10 is designed so that it can be vertically stacked in a compact manner with one or more other similar bases 20.

Figure 4:
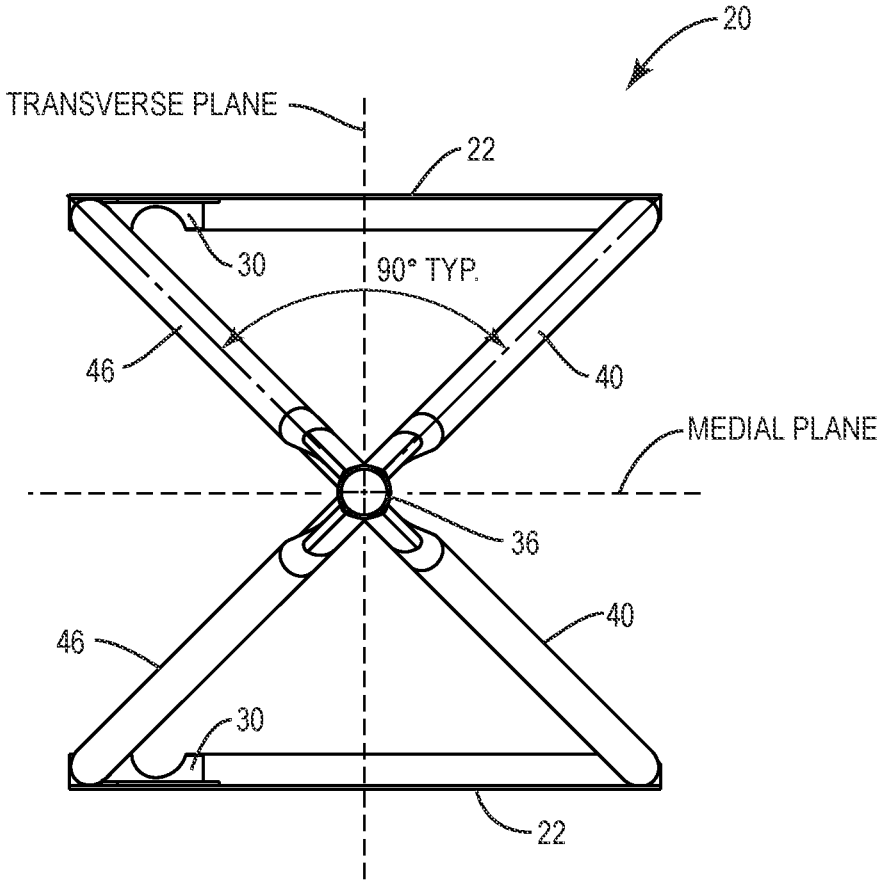
FIG. 4 is a top view of the base.

The base 20 comprises a pair of base members 22 that rest upon the ground, a support column 36 configured to receive the screw jack 60, and four support legs 40, 46 extending between respective base members 22 and the support column 36 to support the support column 36 in a vertical orientation. To facilitate understanding, elements of the boat stand base 20 are described with reference to a medial pane and a transverse plane, both shown in FIG. 4. The transverse plane comprises a vertical plane perpendicular to the plane of the base members 22 dividing the front and back sides of the boat stand base 20. The medial plane comprises a vertical plane perpendicular to the plane of the base members 22 dividing the right and left sides of the boat stand base 20.

Figure 5B:
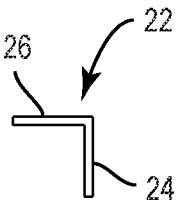
FIGS. 5A and 5B are top and end views respectively of a base member for a base.
Figure 5A:
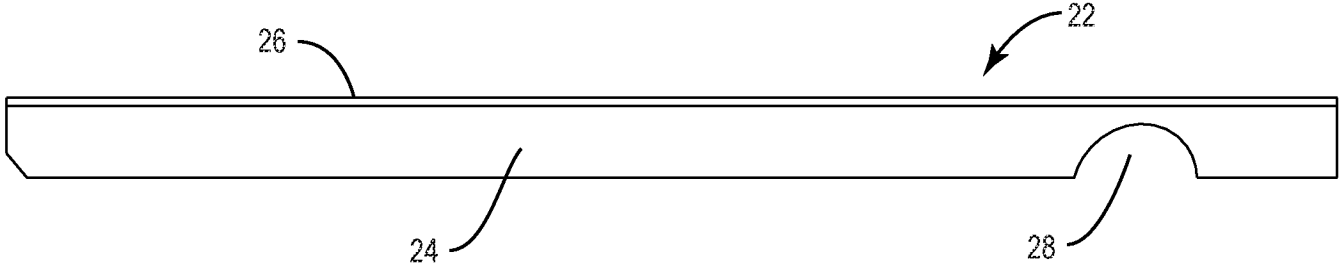
Figure 6A:
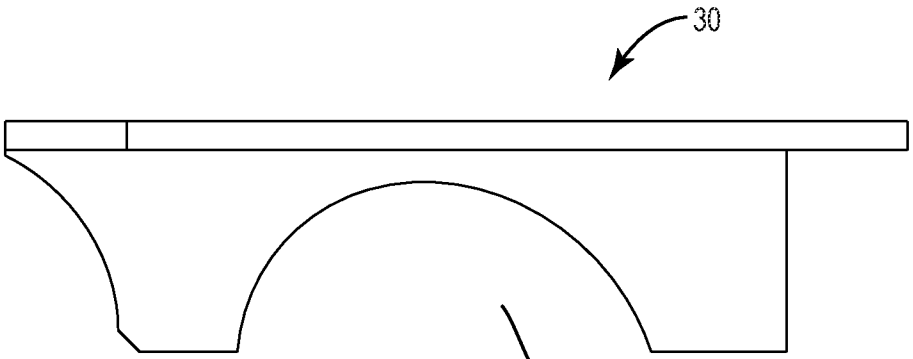
FIGS. 6A-6C are top, side, and end views respectively of a reinforcing member for a base.
Figure 6B:
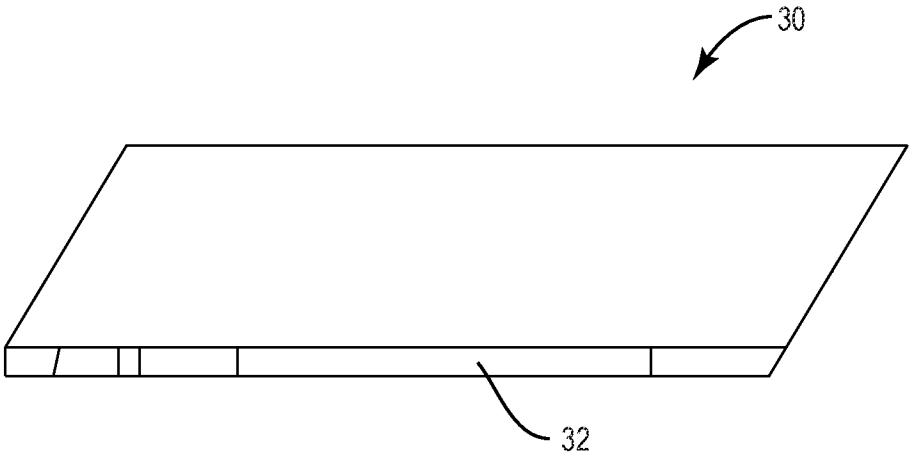
Figure 6C:
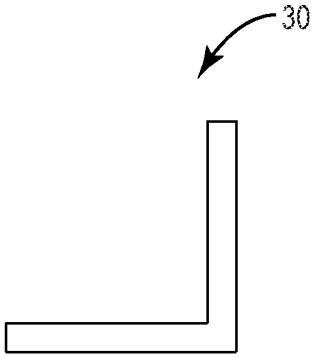

The base members 22, shown in FIGS. 5A and 5B, are each typically a metal angle having a horizontal flange 24 and a vertical flange 26. The base members 22 extend generally parallel to one another on opposite sides of the medial plane of the boat stand base 20. The horizontal flange 24 on each base member includes a notch or cut-out 28 to help reduce/eliminate interference between the base members 22 on one boat stand base 20 and the legs 46 on another boat stand base 20 when the boat stands are stacked. A metal reinforcing member 30, shown in FIGS. 6A and 6B, aligned with the notch or cut-out 28 is optionally secured to the base member 22, for example by welding, to provide strength and rigidity at the point where the notch or cut-out 28 is formed. The reinforcing member 30 typically comprises a short angle with a notch 32 that aligns with the notch 28 in the base member 22.

The support column 36 comprises a metal tube, typically with a generally cylindrical cross-section, disposed at the approximate center of the base 20. In the illustrated embodiment, the support column 36 is oriented perpendicular to the plane of the base members 22 at the intersection of the medial and transverse planes. Those skilled in the art will appreciate that the support column 36 in other embodiments can be located at different points and/or inclined at various angles.

Figure 11:
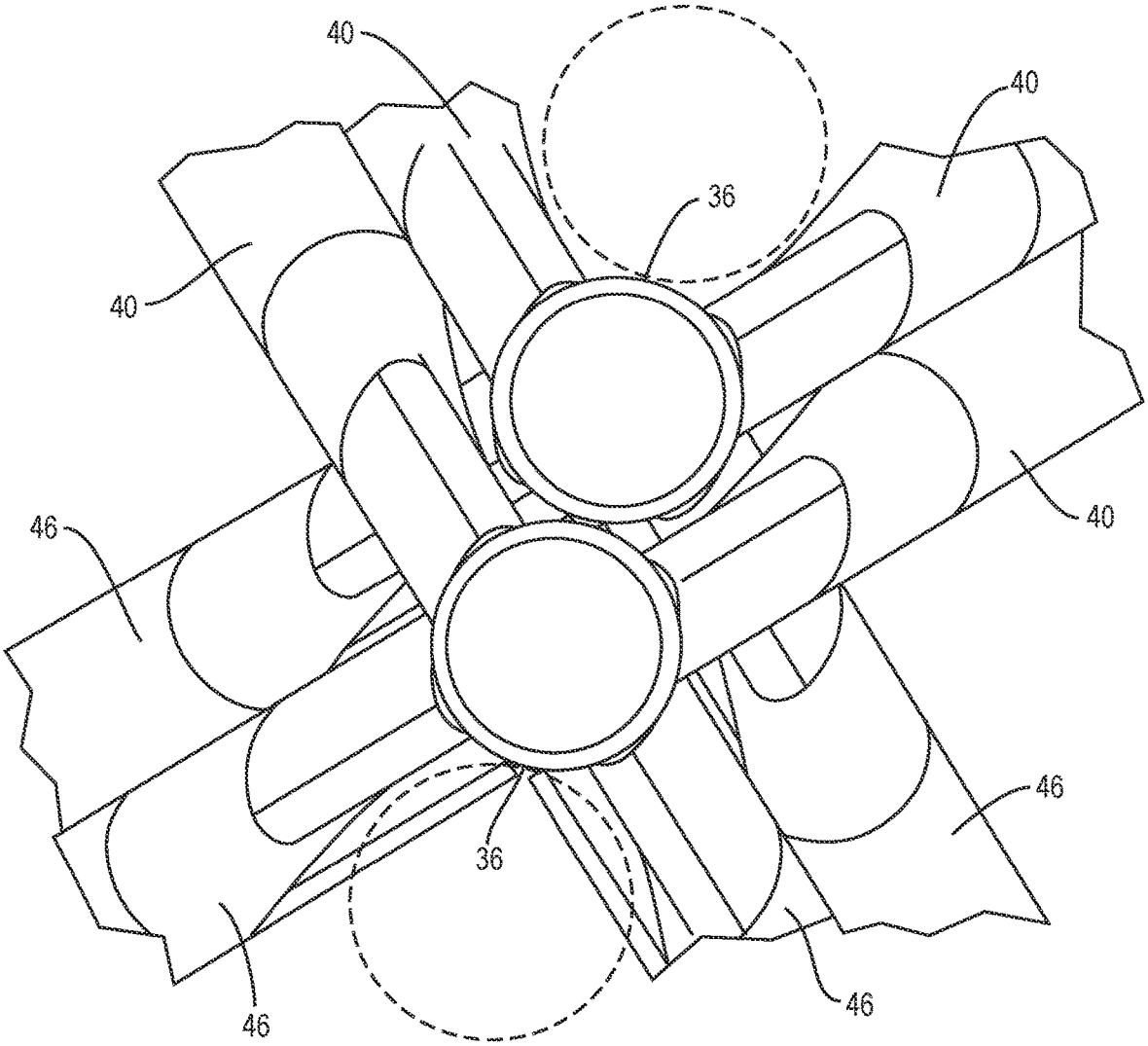
FIG. 11 is a partial top view showing two boat stand bases as herein described in a stack.

Legs 40, 46, shown in FIGS. 7A-7D, extend between the support column 36 and the base members 22 to support the support column 36 in a vertical orientation. Legs 40 extend forward relative to the transverse plane and downward/outward from the support column 36 to the front ends of respective base members 22. Legs 46 extend rearward relative to the transverse plane and downward/outward from the support column 36 to the rear ends of respective base members 22. The lower ends 42, 48 of the legs 40, 46 are cut at an angle and welded to respective base members 22. The upper ends 44, 50 of the legs 40, 46 are crimped and cope welded to the support column 36. As shown in FIGS. 7B and 7C, the crimped ends 44, 50 are not completely closed and are laterally offset from a longitudinal centerline of the leg 40, 46. The more crimped faces of the crimped ends 44, 50 face inward toward the medial plane to create a clearance space proximate to the support column 36 that eliminates interference between the legs 40, 46 of one boat stand base 20 and the support column 36 of another boat stand base 20 when the boat stand bases 20 are stacked as shown in FIG. 11.

To facilitate more compact stacking, the legs 40 are longer than the legs 46. Legs 40 join the support column 36 a first distance D1 from the top end of the support column. Legs 46 join the support column 36 a second distance D2 from the top end of the support column. Distance D2 is greater than distance D1. The difference $\Delta$=D2−D1 is preferably greater than the size/diameter of legs 46. The angle A of legs 40 relative to the transverse plane is smaller than the angle B of the legs 46 relative to the transverse plane. This arrangement allows vertical stacking without interference between the legs 40 as will be hereinafter described.

Optional braces 52, shown in FIGS. 1-2, 8A-8B, may extend between a lower end of the support column 36 and a respective leg 46 to help prevent spreading of the legs 46 when under a load. Each brace 52 typically comprises a metal tube that is cope welded at one end to the support column 36 and extends outward and generally horizontally therefrom, with the opposite end cope welded to a respective leg 46. In some embodiments, there are two braces 52, one corresponding to each leg 46, so that the braces are disposed on one side of the transverse plane, with no braces 52 on the opposing side of the transverse plane so as to facilitate compact stacking of the bases 20. The lower edges of braces 52 may be advantageously disposed approximately coplanar with the lower edges of base members 22 so that the base members 22 and braces 52 jointly form a lower resting surface for the base 20. In alternative embodiments, the braces 52 are mounted to the base members 22 rather than, or in addition to, being mounted to legs 46.

Returning to FIG. 1, the screw jack 60 comprises a threaded shaft 62 that fits into the upper end of the support column 36 and a crank 64 threadably engaged with the threaded shaft 62. The crank 64 comprises a hub 66 threadably engaged with the threaded shaft and wings 68 to enable rotation of the crank 64 by hand. The hub 66 is sized so that it rests on top of the support column 36 when it is under a load. The crank 64 can be turned in a first direction to raise the height of the boat stand 10 and in a second direction to lower the height of the boat stand 10.

The pad assembly 70 comprises a metal plate 72 pivotally attached to the upper end of the treaded shaft 62 and a pad 74 made of wood or elastomeric material that contacts the hull of the boat. The pad 74 can be permanently fixed to the plate 72, such as by an adhesive, or can be removable. Plate 72 advantageously pivots about the axis of the threaded shaft 62 to adjust to the shape of the boat. The details of the pad assembly 70 are not material and further description is omitted for the sake of brevity. An exemplary pad assembly 70 is described in co-pending U.S. patent application entitled "Stand for Supporting a Boat," filed on 12 Feb. 2021, and identified by application Ser. No. 17/174,721. This application is incorporated herein in its entirely by reference.

Figure 9:
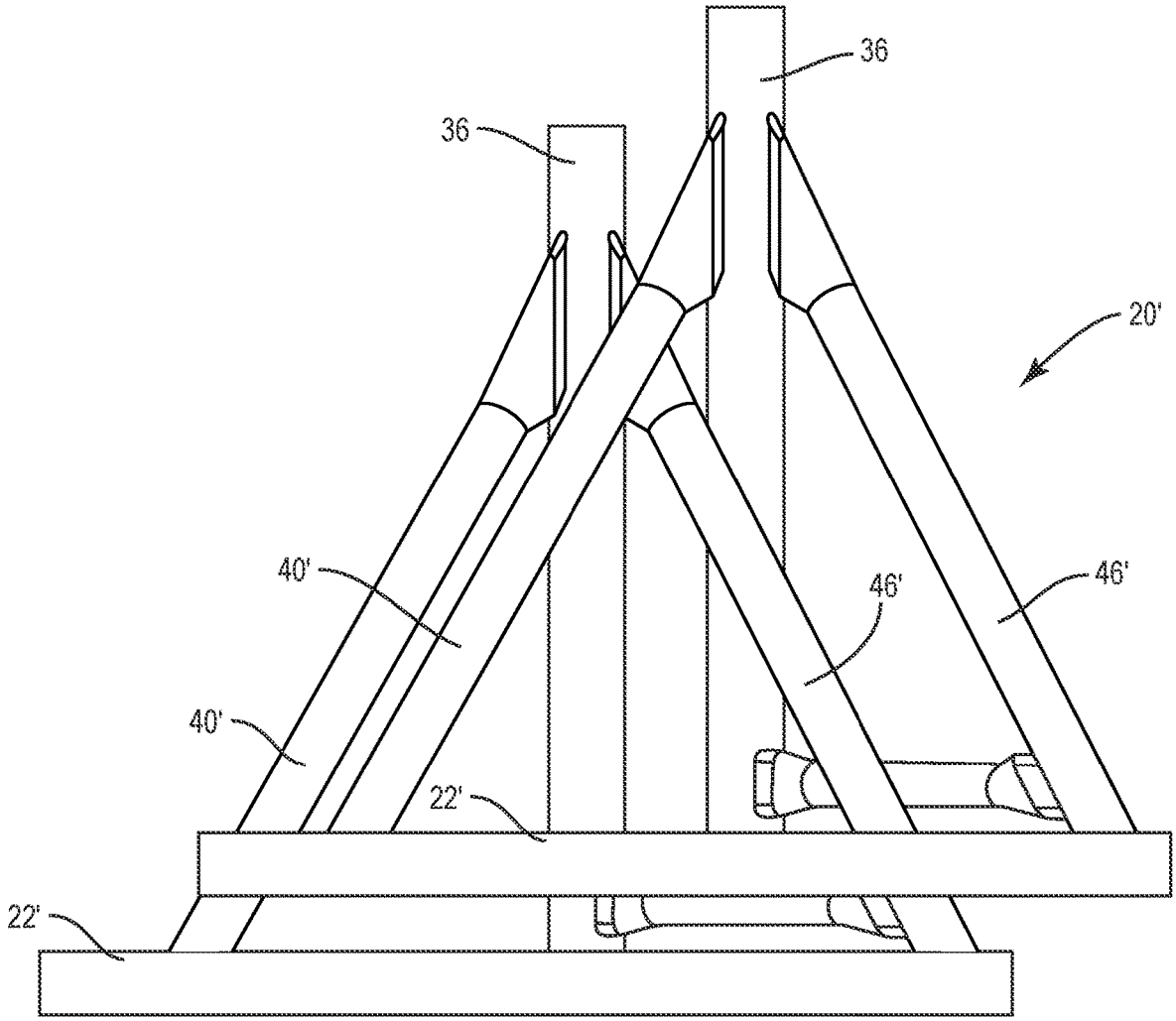
(Prior Art) FIG. 9
FIG. 9 is an elevation view showing a stack of two conventional boat stands.

FIG. 9 is an elevation view showing two conventional boat stand bases 20' in a stack where the legs 40', 46' are equal length and equidistant from the top end of the support column 36'. As shown in FIG. 13, there is a gap between the base members 22' of one boat stand base 20' and the base members 22' of another boat stand base 20'. This gap is attributable to interface (collision) between components when the boat stand bases 20' are stacked.

There are three sources for interference in conventional boat stand bases 20' when the conventional boat stand bases 20' are stacked. First, there is interference between the legs 40', 46' on one conventional boat stand base 20' and the legs 40', 46' on another conventional boat stand base 20'. Second, there is interference between the legs 40', 46' on one conventional boat stand base 20' and the support column 36 on another conventional boat stand base 20'. Third, there is interference between the legs 40,' 46' on one boat conventional stand base 20' and the base members 22' on another conventional boat stand base 20'. Due to one or more of these interference sources, a gap remains between the base members 22' when the conventional boat stand bases 20' are stacked. Additionally, there is a gap between the support columns 36.

Figure 10:
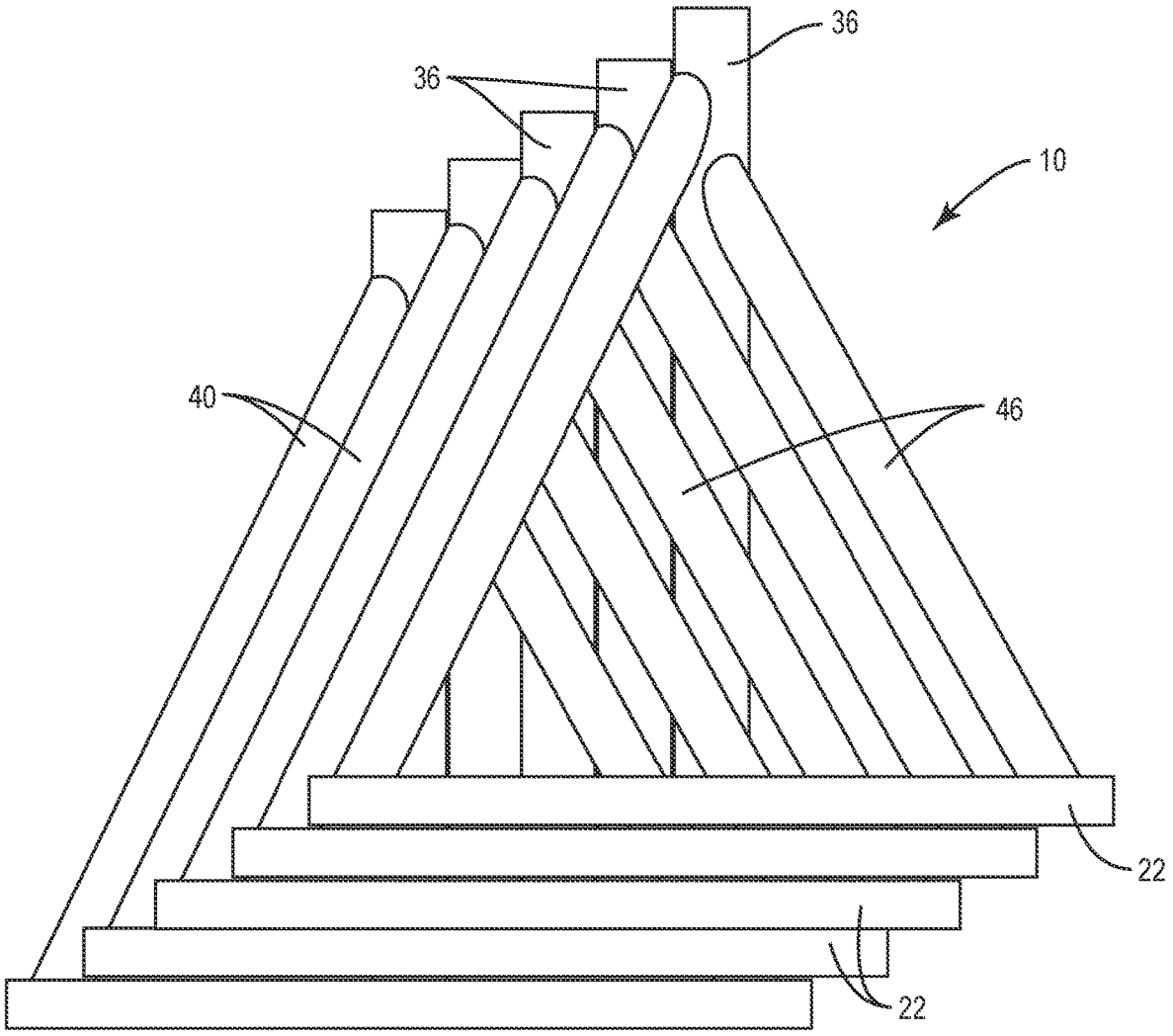
FIG. 10 is an elevation view showing a stack of five boat stand bases as herein described.

The boat stand base 20 as herein described eliminates these potential sources of interference so that the boat stand bases 20 can be stacked more compactly. When the interference is eliminated, the boat stand bases 20 will stack compactly so that there is advantageously no gap between the base members 22, or at least less of a gap, so that stacking is more compact. FIG. 10 is an elevation view showing a stack of five boat stand bases 20 as herein described. As shown in FIG. 10, the boat stand bases 20 stack more compactly in both the vertical and horizontal dimensions.

Boat stand base 20 includes three features that contribute to compact stacking. First, legs 46 are shorter than legs 40 and connect to the support column 36 further from the top end of the support column 36. Preferably, the offset is greater than a diameter of the support legs 46. This feature allows the long support legs 40 of a first boat stand base 20 to pass over the short support legs 46 of a second boat stand base 20 on which it is stacked.

Second, the upper ends of the support legs 40, 46 each include an offset crimp to create a clearance space for the support column 36 of another stacked boat stand base 20. This clearance space is shown by dotted lines in FIG. 11. As shown in FIG. 11, the more crimped face of the crimped area of the offset crimps face inward toward the medial pane of the boat stand bases 20 creating additional space so that the support column 36 on one boat stand base 20 can be placed closer to, such as immediately adjacent to, the support column of another boat stand base 20. In the absence of the offset crimps, the support column 36 would come into contact with the legs 40 or 46, requiring the support columns 36 to be spaced further apart when the boat stand bases 20 are stacked. The offset crimps on the support legs 40, 46 provide a clearance space to reduce/eliminate the interference between the legs 40, 46 and the support columns 36 when the boat stand bases 20 are stacked.

Third, the base members 22, include a notch or cut-out 28 to provide clearance for the support legs 46 when the boat stand bases 20 are stacked. In the absence of the notches or cut-out 28, the base members 22 would come into contact with the legs 46 to prevent the compact stacking of the boat stand bases 20. The notches or cut-outs 28 on the base members 22 provide a clearance space to reduce/eliminate the interference between the legs 46 and the base members 22 when the boat stand bases 20 are stacked.

The present disclosure may, of course, be carried out in other ways than those specifically set forth herein without departing from essential characteristics of the disclosure. The present embodiments are to be considered as illustrative, and all changes coming within the meaning and equivalency range of the appended claims are intended to be embraced therein.

What is claimed is:

1. A boat stand comprising:

a base comprising:

a vertical support column;

a first pair of support legs extending from the support column in a first direction relative to a transverse plane of the boat stand, the first pair of support legs connecting to the support column at a first distance from a top end of the support column;

a second pair of support legs extending from the support column in a second direction relative to the transverse plane, the second pair of support legs connecting to the support column at a second distance from the top end of the support column greater than the first distance so as to enable compact vertical stacking of two or more boat stands;

a first base member connecting the lower ends of a first one of the first support legs and a first one of the second support legs; and a second base member connecting the lower ends of a second one of the first support legs and a second first one of the second support legs;

wherein an end portion of the first and second base members adjacent the second support legs each include a recessed area providing clearance around the second support legs of a second boat stand stacked vertically below the boat stand;

a screw jack received in the support column, and a pad assembly attached to an upper end of the screw jack.

2. The boat stand of claim 1, wherein each of the first pair of support legs includes a crimped end facing toward a medial plane of the boat stand to provide a clearance space for a support column of a second boat stacked below the boat stand.

3. The boat stand of claim 2, wherein each of the second pair of support legs includes a crimped end facing toward the medial plane of the boat stand to provide a clearance space for a support column of a third boat stand stacked above the boat stand.

4. The boat stand of claim 1, wherein the first and second base members comprise angle members including a horizontal flange and a vertical flange.

5. The boat stand of claim 4, wherein the recessed area in the base members comprises notches in the horizontal flanges of the first and second base members.

6. The boat stand of claim 5, further comprising a reinforcing plate on each base member where the notch is formed.

7. The boat stand of claim 1, wherein the base further comprises a pair of braces extending diagonally and generally horizontally between the support column and respective ones of the base members.

8. A base for a boat stand, comprising:

a vertical support column;

a first pair of support legs extending from the support column in a first direction relative to a transverse plane of the boat stand, the first pair of support legs connecting to the support column at a first distance from a top end of the support column;

a second pair of support legs extending from the support column in a second direction relative to the transverse plane, the second pair of support legs connecting to the support column at a second distance from the top end of the support column greater than the first distance so as to enable compact vertical stacking of two or more boat stands;

a first base member connecting the lower ends of a first one of the first support legs and a first one of the second support legs;

a second base member connecting the lower ends of a second one of the first support legs and a second first one of the second support legs;

wherein an end portion of the first and second base members adjacent the second support legs each include a recessed area providing clearance around the second support legs of a second boat stand stacked vertically below the boat stand.

9. The base of claim 8, wherein each of the first pair of support legs includes a crimped end facing toward a medial plane of the boat stand to provide a clearance space for a support column of a second boat stacked below the boat stand.

10. The base of 9, wherein each of the second pair of support legs includes a crimped end facing toward the medial plane of the boat stand to provide a clearance space for a support column of a third boat stand stacked above the boat stand.

11. The base of claim 8, wherein the first and second base members comprise angle members including a horizontal flange and a vertical flange.

12. The base of claim 11, wherein the recessed area in the base members comprises notches in the horizontal flanges of the first and second base members.

13. The base of claim 12, further comprising a reinforcing plate on each base member where the notch is formed.

14. The base of claim 8, wherein the base further comprises a pair of braces extending diagonally and generally horizontally between the support column and respective ones of the base members.

* * * * *